United States Patent [19]

Seeger

[11] 4,163,534

[45] Aug. 7, 1979

[54] STEERING OF AN AERODYNAMIC VEHICLE

[75] Inventor: Hans-Jochen Seeger, Ganderkesee, Fed. Rep. of Germany

[73] Assignee: Vereinigte Flugtechnische Werke-Fokker GmbH, Bremen, Fed. Rep. of Germany

[21] Appl. No.: 905,237

[22] Filed: May 12, 1978

[30] Foreign Application Priority Data

May 13, 1977 [DE] Fed. Rep. of Germany ..... 2721656

[51] Int. Cl.[2] ..... F42B 15/16; F42B 15/18; B64C 15/12; B64C 19/02

[52] U.S. Cl. ..... 244/3.22; 244/52; 244/87

[58] Field of Search ..... 244/52, 87, 88, 3.22, 244/66, 56

[56] References Cited

U.S. PATENT DOCUMENTS

| | | | |
|---|---|---|---|
| 2,621,871 | 12/1952 | Robert | 244/52 |
| 2,639,582 | 5/1953 | Pearlman | 244/52 |
| 2,868,478 | 1/1959 | McCloughy | 244/3.22 |
| 2,991,026 | 7/1961 | Nelson et al. | 244/52 |
| 3,142,153 | 7/1964 | Hensley | 244/52 |
| 3,532,304 | 10/1970 | Pyptiuk | 244/52 |

*Primary Examiner*—Galen L. Barefoot

*Attorney, Agent, or Firm*—Smyth, Pavitt, Siegemund, Jones & Martella

[57] ABSTRACT

A vehicle has two pairs of transversely oriented rudders and duplex nozzles; three motors pivot the rudders and nozzles for yaw, pitch and roll steering whereby each motor drives the requisite rudder(s) and pivots one or two nozzles so that thrust vector and aerodynamic steering is provided always in unison.

9 Claims, 4 Drawing Figures

STEERING OF AN AERODYNAMIC VEHICLE

BACKGROUND OF THE INVENTION

The present invention relates to steering an aerodynamic vehicle, and more particuarly, the invention relates to the control apparatus for steering such a craft, such as a guided ground-to-air missile.

Propelled aerodynamic vehicles can basically be steered in two ways. One mode of operation involves aerodynamic means, such as rudders, airfoils, elevators, etc.; the other mode involves control of the direction of thrust production. Typical control elements here arepivotable nozzles producing thrust. Duplex nozzles are known for that purpose, and are pivoted to change the direction of the thrust vector. Any asymmetry in thrust production tends to change any existing movement, which feature can be utilized for purposes of steering the vehicle. Other ways of thrust vector control involves jet spoilers.

Aerodynamic control surfaces are not suitable at very low speeds (low dynamical pressure), i.e. during takeoff; they loose likewise their effectiveness at very high altitude, i.e. at the upper boundary of the atmosphere, and, of course, in outer space. On the other hand, thrust producing steering elements are always effective whenever the engines run. Thus, one has already proposed to combine both methods of steering in that during takeoff or starting, the vehicle is being steered by thrust vector control; and during normal cruising the rudder(s) take over.

Vehicles of the type to which the invention refers can be propelled, for example, by means of duplex nozzles which are powered by a single engine. Twin or duplex nozzles have the advantage over single nozzles that opposite pivoting of the two nozzles permits production of roll moments, uniform pivoting is used for pitch and yaw control depending on the orientation of the axis about which the nozzles pivot. Thus, duplex nozzles can readily be used to produce control moments about all three axes of the craft.

The known control apparatus for the adjustment of aerodynamic control surfaces as well as for pivoting nozzles, include individual control motors for each task. Accordingly, the number of motors needed is quite high, e.g. eight. As far as rudders is concerned, certain devices are known to operate the control surfaces with three motors only.

DESCRIPTION OF THE INVENTION

It is an object of the present invention to provide a new and improved control apparatus for aerodynamic control surfaces and duplex nozzles of a vehicle such as a guided missile or the like, the apparatus is to be designed to minimize the number of active components.

In accordance with the preferred embodiment of the present invention, it is suggested to provide a control apparatus in which a single motor provides for the pivoting of a nozzle or nozzles and for companion pivoting of a control surface or surfaces for an analogous steering operation.

The preferred embodiment includes a duplex nozzle, and these nozzles are individually pivotable about a common axis whereby pivoting in the same direction provides for yaw steering, pivoting in opposite direction provides for roll steering; both types of steering being provided through thrust vector control. Two motors are provided for this steering operation and the same two motors are drivingly connected to two control surfaces for corresponding aerodynamic yaw and roll steering. The nozzles are further pivoted by a single motor about two parallel axes, extending transversely to the aforementioned axis; the same motor pivots aerodynamic control surfaces about a third axis extending parallel to the two axes. Both controls are provided for pitch steering.

It can thus be seen that the control apparatus, providing for thrust vector and aerodynamic type steering, requires merely three motors. Aside from the economic aspect, this minimum in active components reduces load and thus increases the permissible payload.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Figure 1:
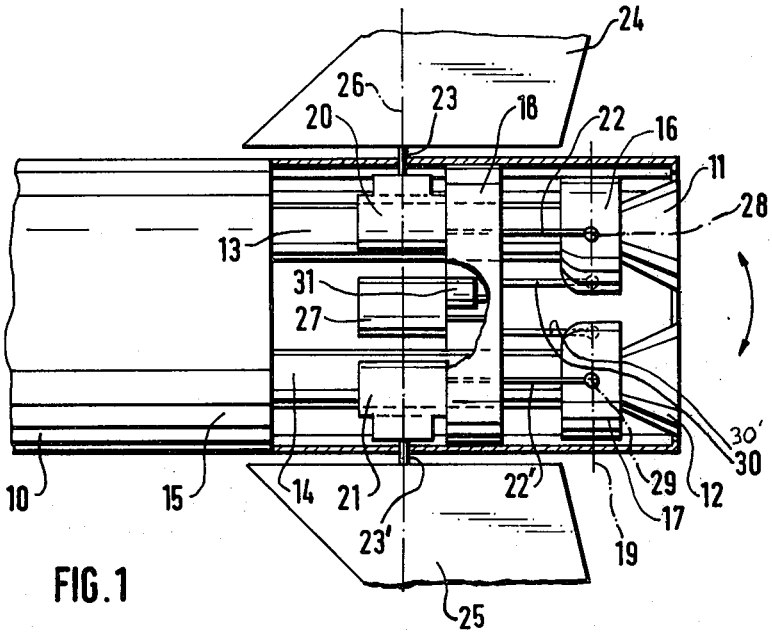
FIG. 1 is a partial section view, partial side elevation of a steering mechanism for an aircraft in accordance with an example of the preferred embodiment of the present invention.

Proceeding now to the detailed description of the drawings, reference numeral 10 refers to a propelled aerodynamic vehicle, such as a guided missile, which is provided with duplex pivot nozzles 11, 12. These two nozzles receive propulsion gas from an engine 15, respectively, via gas conduits 13, 14. The transition from the conduits 13, 14, respectively, to nozzles 11, 12 is provided in ball-and-socket fashion as is known per se. Each of the nozzles 11 and 12 is mounted in a cardan or gimbal frame 16, 17, respectively, which, in turn, are pivotally mounted to a frame 18, to provide for pivot motion about one axis in each instance, the respective nozzle is mounted in the frame for pivoting about a transverse axis.

The duplex nozzles 11, 12 have a first, common adjustment axis 19 but they are individually pivoted by means of adjusting motors 20, 21 which are likewise secured to the frame 18. These motors specifically move control rods 22, 22', being respectively linked to the cardan frames 16 and 17, to pivot the nozzles 11 and 12 about axis 19. Motors 20, 21 may be linear motors or conventional rotary type motors with pinion and rack output to move the rods 22, 22' in longitudinal direction.

The vehicle is additionally provided with aerodynamic control surfaces such as rudders 24 and 25. These rudders can be turned or pivoted by axles 23 and 23'. The axles extend coaxial to each other on an axis 26, which extends parallel to axis 19. Motors 20 and 21 have their output additionally coupled to axles 23, 23' to turn the rudders upon pivoting the nozzles.

The rate of turning in each instance may be determined by transmission gearing interposed between the parts being moved and the drive output of the motors, as the nozzles 11, 12 may well pivot by angles different from the adjustment angles of the rudders. The motors 20 and 21 may be controlled for operation in unison to pivot the nozzles and the rudders in he same direction, or they may be controlled in opposite directions to pivot the control elements correspondingly in opposite directions.

Another motor 27 is fixed to the frame 18 and turns the nozzle 11, 12 about parallel axes 28 and 29 in the gimbal frames. The axes 28 and 29 intersect and extend transversely to axis 19. Specifically, motor 27 drives a first rod 20, linked to pivot nozzle 11 in frame 16, and motor 27 drives also a second rod 30' to pivot nozzle 12. A reversing gear 31 is interposed between the drive output of motor 27, and the actuation rod 30, so that rod 30 pushes when rod 30' pulls and vice versa. Nozzles 11, 12 are, thus, adjusted in synchronism to each other but in the same direction as far as pivoting on the parallel axes 28, 29 is concerned.

Analogously, motor 27 drives another, single shaft 32, supporting a second pair of rudders, 33 and 34. These rudders are pivoted on an axis 35 (axis of shaft 32) which extends parallelly to axes 28 and 29, and transversely to axes 19 and 26. Thus, motor 27 drives also the nozzles 11, 12 as well as rudders 33 and 34.

It follows from the foregoing that the nozzles and the rudders are operated in unison. Pivoting of nozzles 11, 12 and rudders 24, 25 about parallel axes permits production of yaw of vehicle 10, if motors 20, 21 are operated to pivot these elements in the same direction. In the case of opposite rotation by motors 20 and 21, one can obtain roll moments in one or the other direction depending on the chosen directions of motor movement. Motor 27 pivots the two nozzles 11, 12 as well as rudders 33, 34 in unison to produce pitch. Thus, the three motors 20, 21, 27 provide for yaw, roll and pitch steering.

Figure 2:
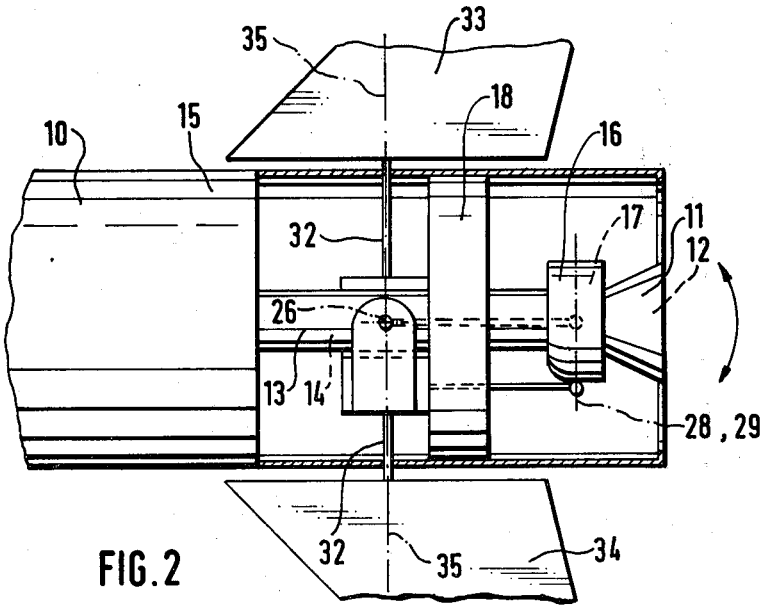
FIG. 2 is a partial section view and partial top elevation of the device shown in FIG. 1.
Figure 3:
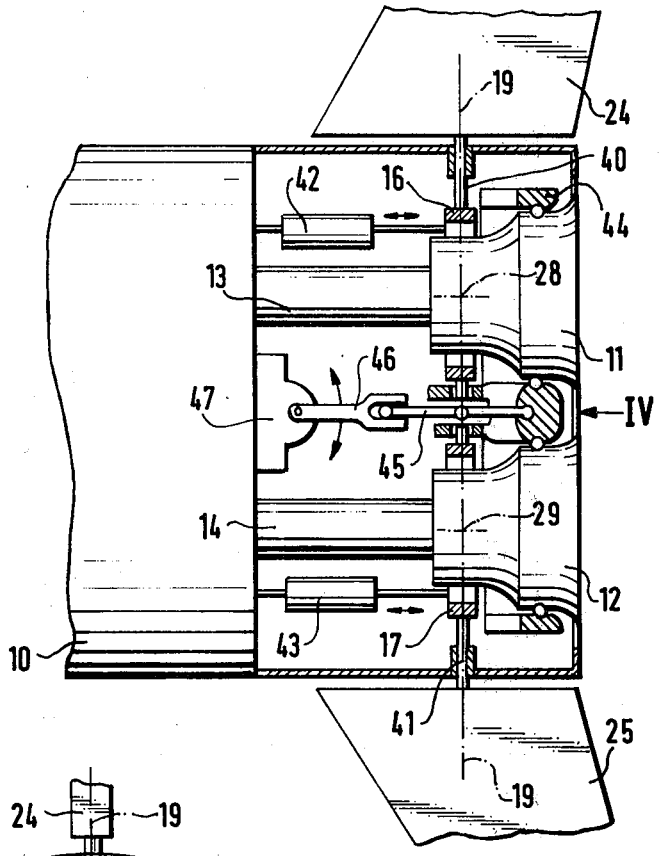
FIG. 3 is a similar type view of another example in accordance with the preferred embodiment.
Figure 4:
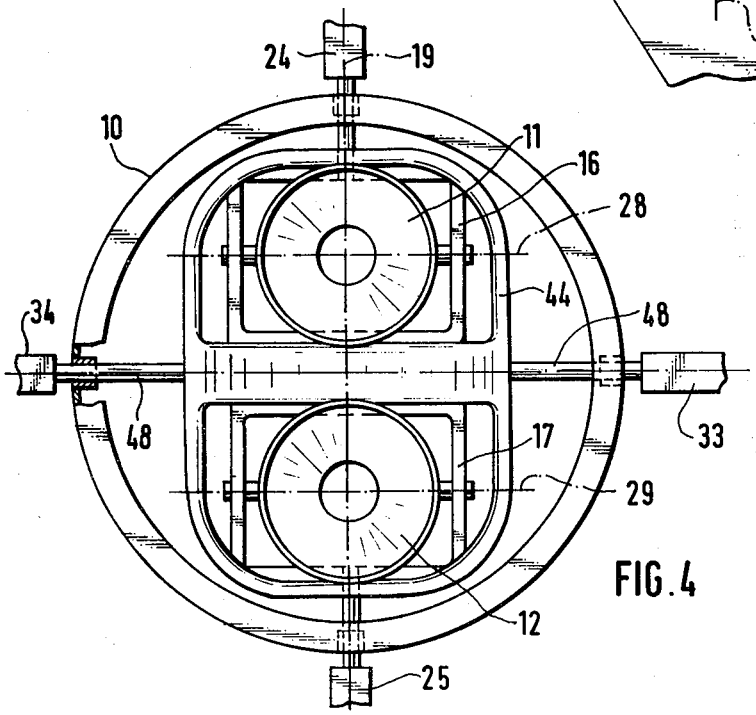
FIG. 4 is a rear view taken in the direction IV of FIG. 3.

The second example depicted in FIGS. 3 and 4 includes also the pivot nozzles 11, 12 in vehicle 10, as well as the gimbal mounts 16, 17 of the nozzles; the mounts 16, 17 are also mounted to a frame. However, that latter mount differs from FIGS. 1 and 2 in that pins 40, 41 of the gimbal mounts 16, 17 are also provided directly with axles for the rudders 24 and 25 on axis 19. In other words, these rudders and nozzle axes coincide.

Reference numerals 42 and 43 refer to the adjustment motors which, respectively, pivot the gimbal frames 16, 17 as indicated by the double arrows. That motion is directly transmitted also upon the rudders 24, 25. Thus, motors 42 and 43 each have a single output only as compared with dual outputs of motors 20, 21 in FIGS. 1 and 2. Controlling the motors for pulling or pushing the rods in unison provides yaw steering; controlling the motors in opposite directions provides roll steering.

As far as the transverse adjustment about axes 28, 29 is concerned, a frame 44 is provided for the nozzles 11, 12 as a common actuating element and being curved in portions on account of the pivot motion of the nozzles about axis 19. Frame 44 is centrally linked to a two arm lever 45 which, in turn, is linked to a fork 46, and the fork 46 is up or down pivoted or tilted by a motor 47. Lever 45 extends from a shaft 48 whose ends are journalled in the frame 18. Upon tilting the arm 45, frame 44 is tilted and causes the nozzles 11, 12 to be pivoted, respectively, about axes 28, 29, within the gimbal frames in which the nozzles are held, and in the same direction.

The two rudders 33 and 34 are also mounted to shaft 48 so that upon pivoting lever 45 about the axis of shaft 48, that shaft turns the rudders 33 and 34. Again, it can be seen that the particular motor 47 requires a single output only.

The two examples operate in quite a similar manner. In each case, yaw is controlled by pivoting the nozzles 11, 12 as well as rudders 24 and 25 in the same direction. Roll is produced by oppositely pivoting these devices. Synchronous pivoting of nozzles 11, 12 about transverse axes coupled with pivoting rudders 33, 34 produces pitch. In each example, only three motors are used and needed to provide all requisite movements for aerodynamic and thrust vector steering.

The invention is not limited to the embodiments described above but all changes and modifications thereof not constituting departures from the spirit and scope of the invention are intended to be included.

I claim:

1. Apparatus for controlling the steering of an aerodynamic, propelled vehicle, comprising:

duplex nozzles including a first and a second thrust producing nozzle;

means for mounting the first and second nozzles for pivoting on a common first axis, and for pivoting each of the nozzles on a separate axis extending transversely to the first axis;

first aerodynamic steering means for the vehicle mounted for pivoting on an axis extending in the same direction as the first axis;

first and second drive motors, respectively, coupled to the first and second nozzles for pivoting them individually about the first axis, further coupled to the first aerodynamic steering means for pivoting the first aerodynamic steering means together with pivoting the nozzles;

second aerodynamic steering means for the vehicle mounted for pivoting on an axis extending parallel to said separate axes; and a third drive motor connected for pivoting the nozzles in unison about the separate axes and the second aerodynamic steering means about its axis.

2. Apparatus as in claim 1, said first aerodynamic steering means including two rudders, respectively, drivingly connected to the first and second drive motors, said second aerodynamic steering means including two rudders drivingly connected to the third drive motor.

3. Apparatus as in claim 1, said first and second drive motors operating rods, respectively, linked to the means for mounting to pivot the nozzles individually and in the same or the opposite direction about the first axis.

4. Apparatus as in claim 1, said first second and third drive motors providing linear movement of rods linked to the nozzles for pivoting them.

5. Apparatus as in claim 4, the third drive motor operating a pair of rods one directly and one in the reverse direction through an interposed reversing gear, the rods being, respectively, linked to the nozzles.

6. Apparatus as in claim 1, said first and second drive motors providing linear movement, there being rods to link the drive motors, respectively, to the nozzles.

7. Apparatus as in claim 6, said third drive motor pivoting lever means, the lever means actuating a pivot frame to pivot the nozzles about said separate axes.

8. Apparatus as in claim 1, said means for mounting including a pair of gimbal frames, respectively, for the nozzles.

9. Apparatus as in claim 8, said gimbal frames provided for pivoting on said first axis by means of shaft means, said first aerodynamic steering means including two rudders, respectively, connected to the shaft means.

* * * * *